United States Patent [19]

Nobuo

[11] 4,059,507

[45] Nov. 22, 1977

[54] CLASSIFYING APPARATUS FOR PARTICULATE MATERIALS

[76] Inventor: Yoshimori Nobuo, No. 143, Ozenji, Tama, Kawasaki, Japan

[21] Appl. No.: 694,611

[22] Filed: June 10, 1976

[30] Foreign Application Priority Data

June 13, 1975 Japan ..... 50-70913

[51] Int. Cl.[2] ..... B07B 9/02

[52] U.S. Cl. ..... 209/139 A; 209/144; 209/148

[58] Field of Search ..... 209/22, 23, 28, 29, 209/139 A, 144, 148

[56] References Cited

U.S. PATENT DOCUMENTS

| | | | |
|---|---|---|---|
| 2,294,921 | 9/1942 | Lykken | 209/144 |
| 2,384,181 | 9/1945 | La Fave | 209/28 |
| 3,483,973 | 12/1969 | Jager | 209/144 |
| 3,620,370 | 11/1971 | Swayze | 209/144 |
| 3,667,600 | 6/1972 | Oi et al. | 209/144 |
| 3,680,695 | 8/1972 | Nobuo et al. | 209/139 A |
| 3,960,714 | 6/1976 | Strauss | 209/148 |

FOREIGN PATENT DOCUMENTS

| | | | |
|---|---|---|---|
| 232,452 | 8/1963 | Austria | 209/139 A |
| 904,772 | 1/1944 | France | 209/29 |

*Primary Examiner*—Frank W. Lutter
*Assistant Examiner*—David L. Lacey
*Attorney, Agent, or Firm*—William Anthony Drucker

[57] ABSTRACT

In classifying apparatus of the type wherein upward whirling flow of fluid is used to separate coarse and fine particles of the particulate material, rotary vanes are mounted on the upper portion of a housing for separating and discharging fine particles, and a rotary disc carrying a plurality of nozzles is provided for projecting jet streams of the fluid against the inner wall of the housing. Vertical and inclined guide plates are provided near the inlet port of the fluid for smoothly guiding coarse particles falling down along the inner side of the housing without being disturbed by the whirling flow of the fluid admitted through the inlet port.

3 Claims, 2 Drawing Figures

CLASSIFYING APPARATUS FOR PARTICULATE MATERIALS

BACKGROUND OF THE INVENTION

This invention relates to classifying apparatus for classifying particulate material according to the particle size.

As is well known in the art the capacity of classifying apparatus is limited by the volume of a cell. More particularly, a high efficiency of classification (the percentage of the particles collected having desired particle size) is essential to classifying apparatus. Although it is possible to maintain the desired efficiency up to a predetermined quantity of the material to be classified commensurate with the capacity of the apparatus, when the quantity of the material loaded in the apparatus exceeds its capacity a large quantity of coarse particles would be accompanied by fine particles and a large quantity of fine particles would be accompanied by coarse particles thus making it difficult to perform a desired classification. For this reason, it is necessary to increase the size or capacity of the apparatus for classifying a large quantity of the particulate material. However, in a cyclone type classifying apparatus wherein a whirling flow of air or water in a cell is utilized to effect classification, increase in the volume of the cell results in only a small increase of the classifying capacity. Thus, even when the volume of the cell is doubled the classifying capacity would never be doubled, but increased only 20 to 30% at the best. Where classification is effected by a whirling flow as in the cyclone type apparatus, increase in the volume of the cell results in only a small increase in the stroke (which acts as the classification zone) of the whirling flow formed along the inner surface of the cell. Rather the volume in which the fluid stays would be increased. As the volume of the cell of the classifying apparatus increases, the quantity of air or other fluid to be blown in should also be increased proportionally. It is also necessary to increase the size of the dispersion plates and whirling vanes provided in the cell for effecting classification thereby increasing the costs of installation and running. Generally speaking, increase in the volume of the cell does not result in proportional increase in the classifying capacity.

In the operation of classifying apparatus utilizing upward whirling flow of a mixture of fluid and particulate material, until the concentration of the particulate material reaches a definite value separation of coarse particles is not satisfactory. It is presumed that the falling of coarse particles is prevented by the upward whirling flow so that while the concentration of the particulate material is low, the downward flow of separated coarse particles is disturbed by the upward whirling flow.

SUMMARY OF THE INVENTION

Accordingly, it is an object of this invention to provide an efficient classifying apparatus capable of efficiently separating fine and coarse particles.

Another object of this invention is to provide improved classifying apparatus including means for preventing falling coarse particles from being disturbed by the upward whirling flow of fluid.

Still another object of this invention is to provide classifying apparatus provided with means for efficiently dispersing particulate material in the upward whirling flow of liquid thereby accelating the separation of coarse particles.

According to this invention these and further objects can be accomplished by providing classifying apparatus comprising a cylindrical housing, an inlet port for admitting fluid into the bottom of the housing to create therein an upward whirling flow of the fluid toward a discharge opening at the top of the housing, means to admit particulate material into the upward whirling flow, rotary vanes mounted near the top of the housing for separating coarse particles from fine particles to discharge the fine particles through the discharge opening, a rotary disc mounted above the inlet port and including a plurality of radial nozzles for projecting jet streams of the fluid against the inner wall of the housing, a plurality of guide plates near the inlet port for smoothly guiding coarse particles falling down along the inner surface of the housing without being disturbed by the whirling flow of the fluid admitted through the inlet port, and a discharge port at the bottom of the housing for discharging coarse particles.

A rotary perforated dispersion plate having a diameter smaller than that of the rotary plate is mounted above the rotary plate for dispersing the particulate material in said upward whirling flow.

BRIEF DESCRIPTION OF THE DRAWING

Further objects and advantages of the invention can be more fully understood from the following detailed description taken in conjunction with the accompanying drawings in which.

DESCRIPTION OF THE PREFERRED EMBODIMENT

Figure 1:
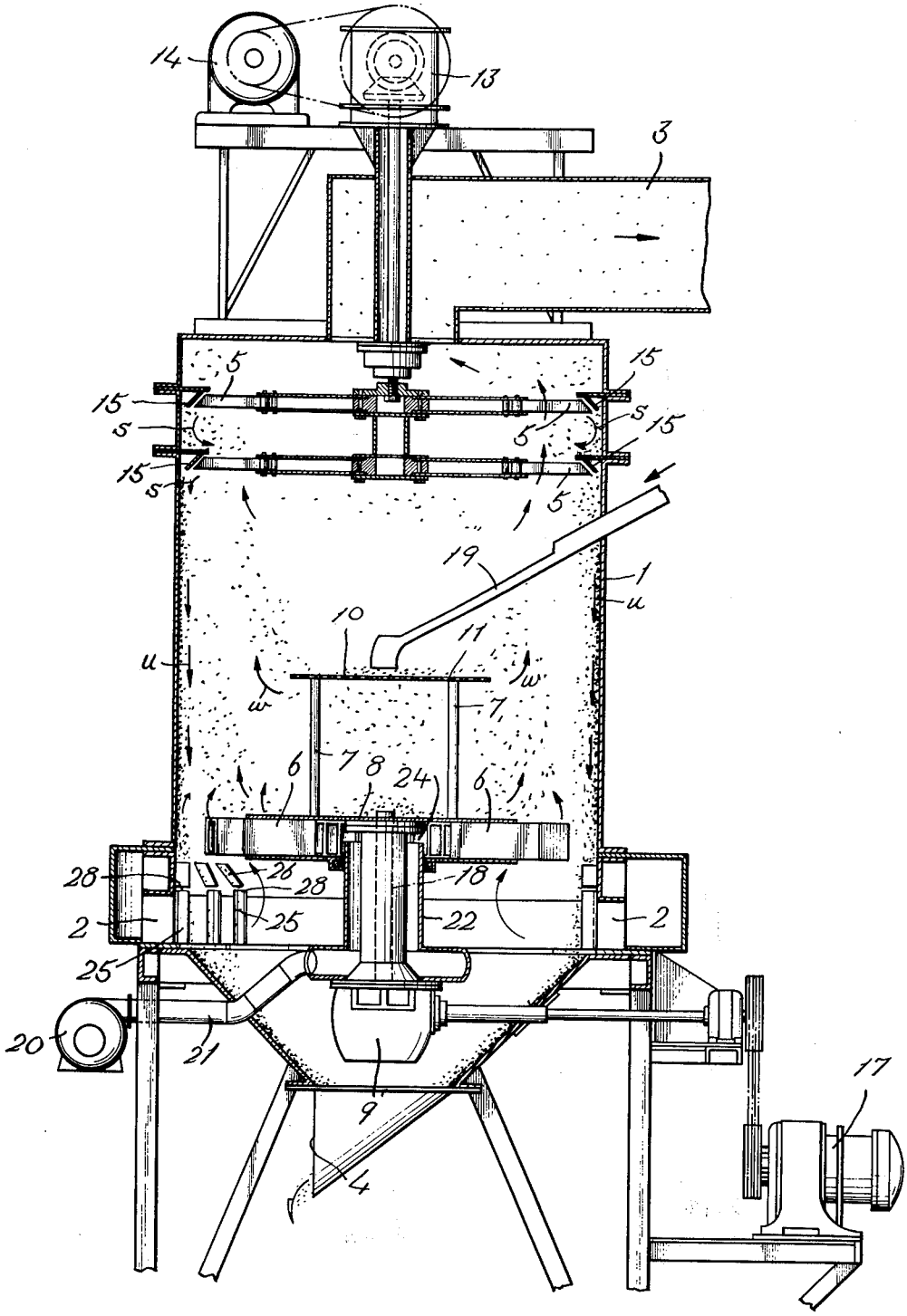
FIG. 1 is a longitudinal sectional view showing one embodiment of the classifying apparatus of this invention.
Figure 2:
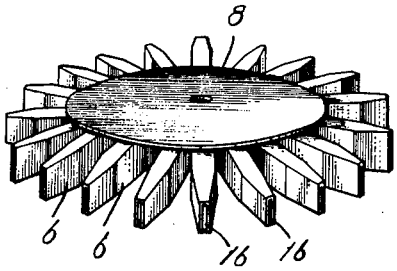
FIG. 2 is a perspective view of a rotary disc provided with a plurality of nozzles.
Figure 3:
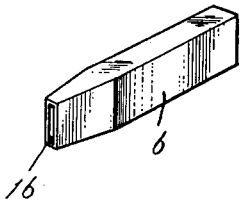
FIG. 3 is a perspective view showing one of the nozzles.

With reference to the accompanying drawings a preferred embodiment shown in FIG. 1 comprises a cylindrical housing 1 provided at its lower end with a plurality of inlet ports 2 arranged in the tangential direction to the periphery of the housing to create a whirling flow of the fluid therein, a discharge duct 3 at the center of the upper end for discharging fine particles of the particulate material to be classified, and a discharge port 4 at the bottom of the housing for discharging coarse particles separated. Fluid is supplied to the inlet ports 2 by a conventional blower (not shown). The construction described above has been well known in the art. According to this invention, rotary vanes 5 are provided near the upper end of the housing for separating coarse particles accompanied by fine particles, and a rotary disc 8 provided with a plurality of radially extending nozzles 6 having narrow ejecting openings 16 is situated slightly above the inlet ports 2 for separating fine particles accompanied by coarse particles. The rotary disc 8 is driven by an electric motor 17 at a suitable speed through a vertical shaft 18 extending from a gear box 9 at the center of the bottom of the housing 1. A plurality of supporting rods 7 are secured to the upper surface of the rotary disc 8 for supporting a dispersion plate 10 at substantially the center of the housing 1. The dispersion plate 10 has a diameter somewhat smaller than that of the rotary disc 8 and is provided with a plurality of small perforations 11. An inclined chute 19 extends through the side wall of the housing for supplying the particulate material to be classified onto the dispersion plate 10. The dispersion plate may be constituted by a perforated flat sheet of metal or a wire net. Since the purpose of the dispersion plate 10 is not to classify the particles by sieving but only to disperse in the radial direction the particulate material by centrifugal force and to drop the material to the lower side thereof it is possible to select the size of the perforations so as to pass the particles without considering the size thereof. As shown in the drawing, the outer ends of the rotary vanes 5 are inclined downwardly, and annular inclined rings 15 are secured to the inner wall of the housing to surround the inclined outer ends of the rotary vanes 5 thus forming restricted passages for the fluid flowing upwardly. The rotary vanes 5 create a downward whirling flow of the fluid as shown by arrows whereby coarse particles accompanied by the upward flow of the fine particles are separated and retained in the housing by directing the coarse particles to the bottom of the housing. The rotary vanes 5 are driven by an electric motor 14 through a gear box 13 mounted on the top of the housing 1. The fluid ejected by the nozzles 6 is supplied by a pump 20 on the outside of the housing 1, through a conduit 21 and a vertical cylinder 22 surrounding shaft 18 to a distributing chamber 24, defined between the upper end of the vertical cylinder 22 and the inner ends of respective nozzles. The fluid supplied to nozzles 6 is the same as that admitted through ports 2. A plurality of vertical guide plates 25 and inclined guide plates 26 each having a suitable width are provided in a space between the lower surface of the guide disc 8 and the bottom wall of the housing. Gaps 28 having a width sufficient to pass coarse particles are formed between adjacent guide plates 25 and 26.

The classifying apparatus described above operates as follows. The rotation of the rotary disc 8, dispersing disc 10 and rotary vanes 5 creates an upward whirling flow of the fluid admitted into the housing through inlet ports 2. By this whirling flow, coarse particles of the material supplied to and dispersed by the dispersing plate 10 are separated from fine particles and fall down along the inner wall of the housing whereas fine particles are discharged to the duct 3 by the action of rotary vanes. In this manner, the quantity of the fine particles accompanied by the coarse particles falling down to the position of the nozzles 6 is decreased remarkably. The downward flow of the coarse particles is subjected again to the classifying action of the jet streams ejecting from nozzles 6. Consequently, only a small number of the fine particles are contained in the coarse particles that fall down across the jet streams. Although the coarse particles have a tendency to be blown upwardly by a strong upward whirling flow of the fluid blown into the housing through the inlet ports 2, the guide plates 25 and 26 positioned near the inner surface of the housing form a low speed or stay region so that the coarse particles continue to fall down through gaps 28 and along the surface of the guide plates 25 to the bottom of the housing. In this manner, coarse particles are efficiently separated from fine particles. The rotary vanes 5 positioned at the upper portion of the housing are effective to separate the coarse particles from the upward flow of the fine particles. This separating action is added to the above described action of separating fine particles from fine particles thereby increasing the efficiency of separation. Furthermore, perforated dispersion plate 10 is mounted on the rotary disc 8 with a predetermined spacing therebetween so that the particulate material is not only dispersed in the radial direction by the centrifugal force of the dispersion plate 10 but also falls down through the perforations 11. The particles dispersed in the radial direction by the dispersion plate are conveyed toward the discharge conduit 3 by the upward whirling flow. Also in the space between two rotary members a turbulent upward flow is formed to bring upwardly the particles, preferentially the small particles that have fallen down through the perforations 11 of the dispersion plate 10. In other words, classification is also done in this region. As a consequence, the particles fallen on the upper surface of the rotary disc consist essentially of large particles which are again dispersed in the radial direction by the centrifugal force of the rotary disc to be subjected to the sorting action of a relatively high speed upward whirling flow created by the jet streams ejecting through the nozzles with the result that most of the fine particles are conveyed upwardly by the high speed upward whirling flow. Provision of the dispersion plate 10 at the central region of the housing causes flow of the particles along the inner surface of the housing which is quite different from the flow of the conventional classifying apparatus not provided with such dispersion disc. More particularly, in a classifying machine utilizing an upward whirling flow, a downward flow mainly containing large particles is created along the inner surface of the housing but in a machine utilizing a single rotary disc at the bottom for dispersing all material admitted into the machine, as the material dispersed by the rotary disc and containing a large amount of the small particles is admixed with the downward flow of the coarse particles along the inner surface of the housing the efficiency of classification is decreased. On the contrary, according to this invention, the perforated dispersion plate 10 primarily separates the large particles from the fine particles at the central portion of the housing. In addition a secondary separation is effected in the space between the rotary disc 8 and the dispersion plate 10 by an upward turbulent flow in which fine particles are preferentially sorted. Finally, a downward flow consisting essentially of coarse particles is subjected to the jet streams ejecting through nozzles 6 for further removing fine particles. Thus, the separations of the fine particles are performed at various portions. The downward flow of the coarse particles through gaps 28 and along guide plates 25 and 26 would not be disturbed by the flow of the fluid supplied through inlet ports 2 for the purpose of creating the upward whirling flow because the flow speed of the fluid is not so high at the inlet ports 2. In this manner, the material is dispersed twice at portions vertically spaced apart so that even when a large quantity of the material is loaded in the apparatus it is possible to classify it at high efficiencies. It is to be noted that the diameter of the dispersion plate 10 is substantially smaller than the inner diameter of the housing so that the upward whirling flow does not interfere with the downward flow of the coarse particles along the inner wall of the housing.

To demonstrate the advantageous function of this invention the following data is given.

A powder of clay having a particle size of 300 mesh was classified by a classifying machine having an inside diameter of 800 mm and using an air quantity of 60 – 100 $Nm^3$/min. In this test, the capacity of the prior art machine was about 1,000 Kg/hr at the best, whereas in the machine embodying the invention the capacity was increased to 3,000 Kg/hour or more. Even when the quantity of the charge is increased to obtain a capacity higher than 4,000 Kg/hr an excellent result was obtained. When the size of the particles to be classified is set to such small size as 10 microns, a classification efficiency as high as 86% was obtained. When the size of classification of a powder of aluminum hydroxide which has been considered to be most difficult to classify is set to 10 microns the classification efficiency to the prior art apparatus is extremely low. With apparatus described in my British patent specification No. 1,376,436, the efficiency is only 15.1%. However, with the novel apparatus of this invention, the classification efficiency was increased to more than 20%, and 26 – 27% in some cases.

According to this invention, it is not only possible to efficiently remove fine particles accompanied by coarse particles by the jet streams ejected from the nozzles 6 but also possible to prevent the coarse particles from being disturbed by the upward whirling flow at the inlet port thereof by using inclined guide plates and vertical guide plates thereby smoothly discharging the coarse particles. This improves the capacity and efficiency of the classifying apparatus. Accordingly it is possible to classify particulate material even when the limit of particle size is small, for example 10 microns, or even when the material is difficult to classify.

What is claimed is:

1. Apparatus, for classifying particulate material, comprising in combination:

i. a housing having a cylindrical wall and having at its top end a discharge opening for fine particulate material and at its bottom end a discharge opening for coarser particulate material ii. means adjacent the bottom end of said housing for admitting a flow of fluid tangentially into said housing, thereby to create an upward whirling flow of fluid in said housing towards said top end discharge opening iii. means disposed intermediate said top end and said bottom end of said housing for admitting mixed fine and coarser particulate material into said upward whirling flow of fluid iv. rotary vanes disposed in said housing adjacent the top end thereof for separating coarser particles from fine particles, such that said fine particles may be discharged through said top end discharge opening v. a rotary disc disposed in said housing above said flow admitting means and below said rotary vanes, said disc including a plurality of radial nozzles, vi. blower means connected to said nozzles for blowing fluid through said nozzles to project said fluid from said blower means as jet streams against the wall of said housing vii. a plurality of guide plates disposed in said housing adjacent to said flow admitting means for smoothly guiding coarser particles falling down along the wall of said housing such that said falling particles are not disturbed by the whirling flow of fluid admitted through said flow admitting means, and viii. a rotary dispersion plate disposed in said housing between said rotary disc and said material admitting means to receive thereon material admitted by said material admitting means, said plate being of less diameter than said rotary disc and being perforated to permit a portion of said admitted material to fall into a space between said plate and said rotary disc.

2. Apparatus, as claimed in claim 1, wherein said guide plates comprise:

a. a plurality of vertical guide plates disposed in said housing in alignment with said flow admitting means and spaced radially inwards from the wall of said housing, and b. a plurality of inclined guide plates disposed in said housing at a spacing above said vertical guide plates and between said vertical guide plates and said rotary disc, said inclined guide plates inclining in the upward direction from said vertical guide plates towards the wall of the housing.

3. Apparatus, as claimed in claim 1, wherein said rotary disc is driven by a vertical shaft extending through the bottom of said housing, and wherein conduit means connecting said blower means to said nozzles includes a pipe positioned in spaced relationship about said vertical shaft.

* * * * *